US011282423B2

(12) United States Patent
Choi et al.

(10) Patent No.: US 11,282,423 B2
(45) Date of Patent: Mar. 22, 2022

(54) ROLLABLE DISPLAY DEVICE HAVING VARIABLE DATA PROCESSING POSITIONS FOR PIXELS AND DATA PROCESSING METHOD THEREOF

(71) Applicant: LG Display Co., Ltd., Seoul (KR)

(72) Inventors: Seong-Min Choi, Goyang-si (KR); Jin-Young Oh, Paju-si (KR); Eun-Kyung Hong, Paju-si (KR); Min-Jae Yoo, Seoul (KR); Jae-Yoon Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/119,751

(22) Filed: Dec. 11, 2020

(65) Prior Publication Data

US 2021/0201724 A1 Jul. 1, 2021

(30) Foreign Application Priority Data

Dec. 30, 2019 (KR) ..... 10-2019-0177990

(51) Int. Cl.
*G09G 3/00* (2006.01)

(52) U.S. Cl.
CPC ..... *G09G 3/035* (2020.08); *G09G 2310/08* (2013.01); *G09G 2340/0442* (2013.01); *G09G 2380/02* (2013.01)

(58) Field of Classification Search
CPC ..... G09G 3/035; G09G 2310/08; G09G 2340/0442; G09G 2380/02; H04M 1/0268; H01L 51/0097; H01L 27/3218; H01L 27/3276; H01L 27/323; H01L 27/3216; H01L 33/62; G02F 1/133305
See application file for complete search history.

(56) References Cited

U.S. PATENT DOCUMENTS

2014/0231763 A1* 8/2014 Kim ..... H01L 27/3276 257/40
2014/0361262 A1* 12/2014 Kim ..... H01L 27/3218 257/40
2016/0141353 A1* 5/2016 Kim ..... H01L 27/3216 257/773
2016/0227623 A1* 8/2016 Yoo ..... H01L 51/0097
2018/0032106 A1* 2/2018 Yu ..... H04M 1/0268
(Continued)

FOREIGN PATENT DOCUMENTS

KR 10-2016-0150533 A 12/2016

*Primary Examiner* — Richard J Hong
(74) *Attorney, Agent, or Firm* — Seed IP Law Group LLP

(57) ABSTRACT

The present disclosure relates to a display device capable of improving image processing capability by varying a spatial processing resolution of a bit depth of data according to change in a display area, and a display device according to an embodiment includes: a panel including a display area composed of a plurality of pixels and having a variable physical shape; a panel driver for driving the panel; and a timing controller for varying the area of a first display area in which an image is displayed in the display area according to change in the shape of the panel when the change in the shape of the panel is detected through a sensor and varying a distance between pixels on which compensation processing is performed in pixels corresponding to the first display area in response to the varied area of the first display area.

8 Claims, 7 Drawing Sheets

(56) References Cited

U.S. PATENT DOCUMENTS

| | | | | |
|---|---|---|---|---|
| 2018/0040680 | A1* | 2/2018 | Cai | H01L 51/0097 |
| 2019/0005870 | A1* | 1/2019 | Son | H01L 33/62 |
| 2019/0261519 | A1* | 8/2019 | Park | G02F 1/133305 |
| 2019/0371869 | A1* | 12/2019 | Yan | H01L 51/0097 |
| 2021/0175297 | A1* | 6/2021 | Kim | H01L 27/323 |

* cited by examiner

ROLLABLE DISPLAY DEVICE HAVING VARIABLE DATA PROCESSING POSITIONS FOR PIXELS AND DATA PROCESSING METHOD THEREOF

CROSS-REFERENCE TO RELATED APPLICATION

This application claims the benefit of Republic of Korean Patent Application No. 10-2019-0177990, filed Dec. 30, 2019, which is incorporated by reference in its entirety.

BACKGROUND

Technical Field

The present disclosure relates to a display device and a data processing method thereof which can improve image processing capability by varying a spatial processing resolution or a bit depth of data according to change in a display area.

Description of the Related Art

Flexible display devices that can be folded or unfolded by users are developed according to enhancement of display technology. Flexible display devices include various display devices, shapes of which can be changed, such as foldable, bendable, rollable and stretchable display panels.

An organic light-emitting diode (OLED) display device uses spontaneous emitting elements and thus has a high luminance and a low driving voltage and can be implemented in various shapes in a very thin structure. Accordingly, the OLED display device is mainly used as a flexible display device.

The OLED display device senses and compensates for deterioration of each pixel including an emission element and a driving thin film transistor (TFT), and for these sensing and compensation operations, uses compensation data stored in a memory.

Although a rollable display device has a display area variable according to a rolled state, utilization of a memory thereof may decrease because a spatial resolution or a bit depth with respect to internally processed data does not change.

The rollable display device is required to improve definition of a frequently used display area.

BRIEF SUMMARY

One or more embodiments of the present disclosure provides a display device and a data processing method thereof which can improve image processing capability by varying a spatial processing resolution or a bit depth of data according to change in a display area.

A display device according to various embodiments includes: a panel including a display area composed of a plurality of pixels and having a variable physical shape; a panel driver for driving the panel; and a timing controller for varying the area of a first display area in which an image is displayed in the display area according to change in the shape of the panel when the change in the shape of the panel is detected through a sensor and varying a distance between pixels on which compensation processing is performed in pixels corresponding to the first display area in response to the varied area of the first display area.

The timing controller may reduce the distance between the pixels on which compensation processing is performed when the area of the first display area decreases.

The timing controller may vary the distance between the pixels on which compensation processing is performed by changing a sampling position of compensation data downloaded from an external memory to an internal memory in response to the varied area of the first display area and compensating for data of a corresponding pixel using the downloaded compensation data.

The timing controller may include: a display area change detector for detecting change of the first display area according to change in the shape of the panel; a display area calculator for calculating the varied area of the first display area; a data resolution calculator for calculating a data processing resolution corresponding to the calculated area of the first display area; a memory address change processor for varying an address according to the calculated data processing resolution; a data download processor for sampling compensation data from an external memory using the varied address and downloading the compensation data to an internal memory; and a definition enhancement data processor for compensating for data of a corresponding pixel using the downloaded compensation data.

The timing controller may further include a display area change monitor for monitoring the area of the first display area calculated by the display area calculator, and when the varied area of the first display area is maintained for a set period, controls the data download processor to download the compensation data from the external memory to the internal memory.

The panel may be a foldable panel or a rollable panel.

A data processing method of a display device according to various embodiments includes: detecting change in the area of a display area in which an image is display according to change in a shape of a panel; calculating the changed area of the display area according to change in the shape of the panel; calculating a data processing resolution corresponding to the calculated display area; sampling compensation data from an external memory and downloading the compensation data to an internal memory in response to the calculated data processing resolution; and compensating for data of a corresponding pixel using the compensation data downloaded to the internal memory.

When the area of the display area decreases, the data processing resolution may increase to enhance both a resolution of the downloaded compensation data and a resolution of the compensated data.

The data processing method according to various embodiments may further include monitoring the calculated area of the display area, and when the changed area of the display area is maintained for a set period, controlling the compensation data such that the compensation data is downloaded from the external memory to the internal memory.

The display device according to various embodiments can vary a resolution of compensation data downloaded from an external memory to an internal memory according to change in the area of a display area to vary a spatial processing resolution of data processed using the compensation data.

Accordingly, when the area of the display area decreases according to change in the shape of the panel of the display device, image processing capability can be improved to enhance product quality and extend the lifespan of products by reducing the size of a sampling block unit to increase the resolution of compensation data and the resolution of data processed using the compensation data.

The display device according to various embodiments can increase a bit depth of compensation data or accumulated stress data in response to change in the area of the display area to improve compensation capability using the same and thus can enhance image processing capability and extend the lifespan.

DETAILED DESCRIPTION

Hereinafter, preferred embodiments of the present disclosure will be described with reference to the drawings.

Figure 1:
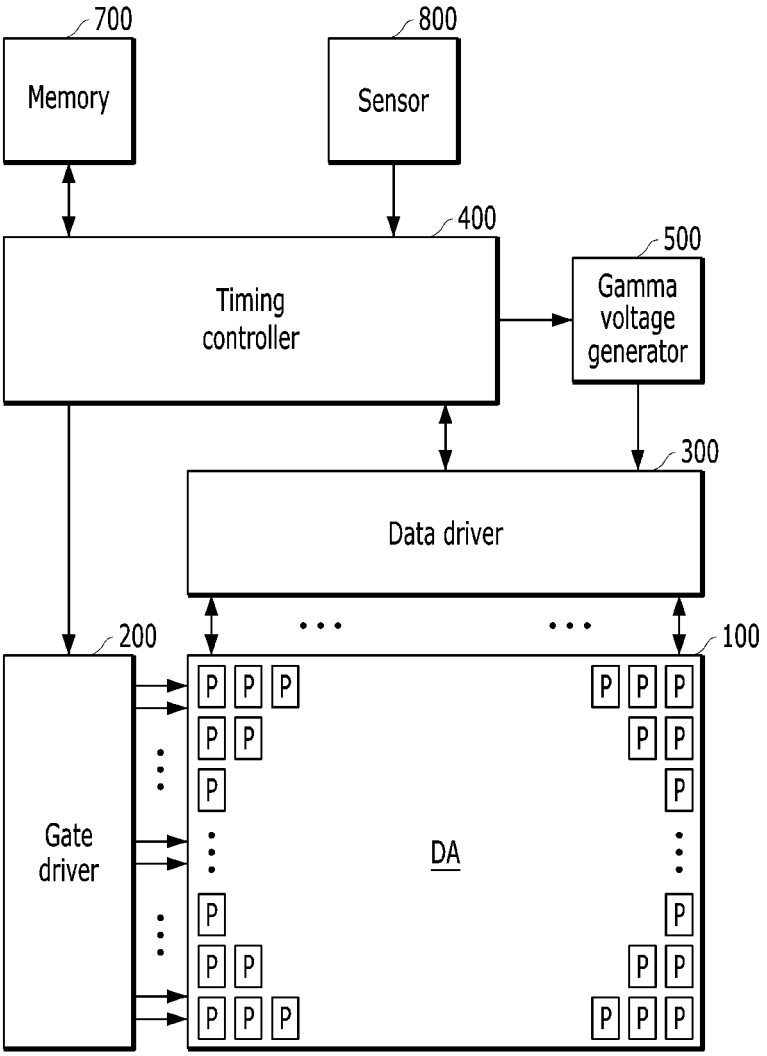
FIG. 1 is a block diagram schematically showing a display device according to various embodiments.
Figure 2:
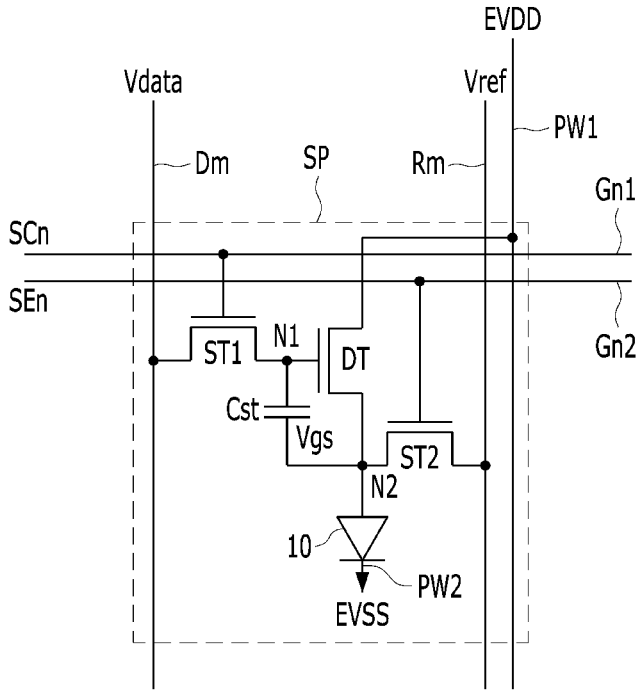
FIG. 2 is an equivalent circuit diagram showing a pixel configuration of the display device according to various embodiments.
Figure 3:
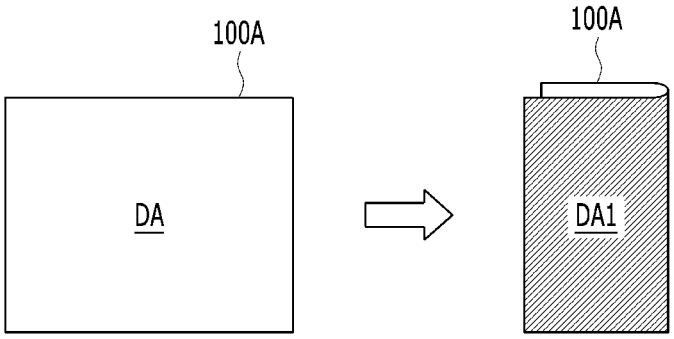
FIG. 3 is a diagram showing a folding state of a display device according to various embodiments.
Figure 4:
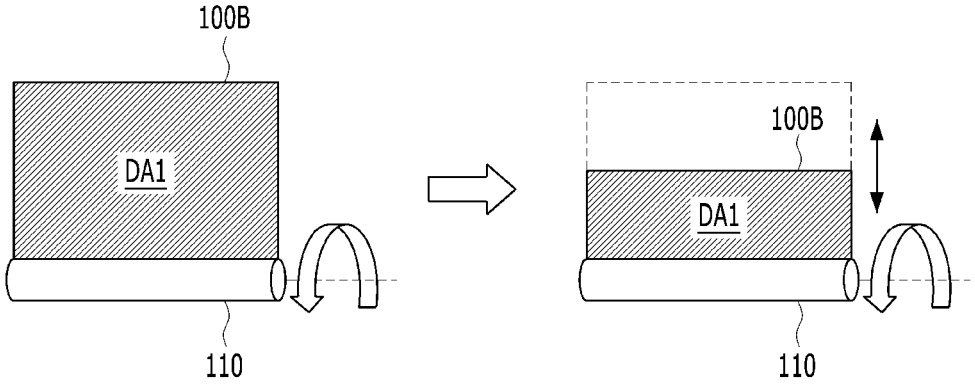
FIG. 4 is a diagram showing a rolled state of a display device according to various embodiments.

FIG. 1 is a block diagram schematically showing a display device according to various embodiments, FIG. 2 is an equivalent circuit diagram showing a pixel configuration of the display device according to various embodiments, FIG. 3 is a diagram showing a folding state of a foldable panel according to various embodiments, and FIG. 4 is a diagram showing a rolled state of a rollable panel according to various embodiments.

Referring to FIGS. 1 and 2, the display device may include a panel 100, a gate driver 200, a data driver 300, a timing controller 400, a gamma voltage generator 500, a memory 600, and a sensor 800. In FIG. 1, the gate driver 200 and the data driver 300 may be referred to as a panel driver for driving the panel 100. The gate driver 200, the data driver 300, the timing controller 400, and the gamma voltage generator 500 may be collectively referred to as a driver.

The panel 100 may have a variable shape such as a foldable, rollable or stretchable panel and thus the shape of the panel 100 can be varied according to environments in which the display device is used by a user. The area of a first display area in which images are displayed in a display area DA, that is, the area of a viewing area, can be varied according to change in the shape of the panel 100.

The panel 100 displays an image through the display area DA composed of a pixel array. The pixel array may include red, green and blue pixels P and further include white pixels P.

Each pixel P includes an emission element and a pixel circuit for independently driving the emission element. As the emission element, an organic light-emitting diode, a quantum-dot light-emitting diode or an inorganic light-emitting diode may be used. The pixel circuit includes a plurality of TFTs including at least a driving TFT for driving the emission element and a switching TFT for supplying a data signal to the driving TFT, and a storage capacitor that stores a driving voltage Vgs corresponding to a data signal supplied through the switching TFT and supplies the driving voltage Vgs to the driving TFT. In addition, the pixel circuit may further include a plurality of TFTs for initializing three elements (a gate, a source and a drain) of the driving TFT, connecting the driving TFT in a diode structure for threshold voltage compensation, or controlling an emission time of the emission element. Various configurations such as 3T1C (3 TFTs and 1 capacitor) and 7T1C (7 TFTs and 1 capacitor) are applicable as a configuration of the pixel circuit.

For example, as shown in FIG. 2, each pixel P includes a pixel circuit including at least an emission element 10 connected between a power line through which a high driving voltage (first driving voltage EVDD) is supplied and a common electrode through which a low driving voltage (second driving voltage EVSS) is supplied, and first and second switching TFTs ST1 and ST2, a driving TFT DT and a storage capacitor Cst for independently driving the emission element 10.

The emission element 10 may include an anode connected to a source node N1 of the driving TFT DT, a cathode connected to an EVSS line PW2, and an organic emission layer formed between the anode and the cathode. The anode is independent for each subpixel but the cathode may be a common electrode shared by subpixels. The emission element 10 generates light with brightness in proportion to a driving current supplied from the driving TFT DT in such a manner that electrons from the cathode are injected into the organic emission layer and holes from the anode are injected into the organic emission layer when the driving current is supplied from the driving TFT DT and electrons and holes are recombined in the organic emission layer to fluoresce or phosphoresce.

The first switching TFT ST1 is driven by a scan pulse signal SCn supplied from the gate driver 200 to a gate line Gn1 and provides a data voltage Vdata supplied from the data driver 300 to a data line Dm to a gate node N1 of the driving TFT DT.

The second switching TFT ST2 is driven by a sense pulse signal Sen supplied from the gate driver 200 to another gate line Gn2 and provides a reference voltage Vref supplied from the data driver 300 to a reference line Rm to the source node N2 of the driving TFT DT. In a sensing mode, the second switching TFT ST2 can provide a current in which characteristics of the driving TFT DT or characteristics of the emission element 10 are reflected to the reference line Rm.

The storage capacitor Cst connected between the gate node N1 and the source node N2 of the driving TFT DT charges a difference voltage between the data voltage Vdata and the reference voltage Vref respectively supplied to the gate node N1 and the source node N2 through the first and second switching TFTs ST1 and ST2 as a driving voltage Vgs of the driving TFT DT and holds the charged driving voltage Vgs for an emission period in which the first and second switching TFTs ST1 and ST2 are turned off.

The driving TFT DT controls a current supplied through an EVDD line PW1 in response to the driving voltage Vgs supplied from the storage capacitor Cst to provide a driving current determined by the driving voltage Vgs to the emission element 10, causing the emission element 10 to emit light.

The gate driver 200 is controlled by a plurality of gate control signals supplied from the timing controller 400 and individually drives gate lines of the panel 100. The gate driver 200 supplies a scan signal at a gate on voltage to a gate line in a driving period of the gate line and supplies a gate off voltage to the gate line in a non-driving period of the gate line.

The gamma voltage generator 500 generates a plurality of different reference gamma voltages having different voltage levels and provides the reference gamma voltages to the data driver 300. The gamma voltage generator 500 can adjust a reference gamma voltage level according to control of the timing controller 400.

The data driver 300 is controlled by a data control signal supplied from the timing controller 400, converts digital data received from the timing controller 400 into an analog data signal and provides the data signal to each data line of the panel 100. Here, the data driver 300 converts the digital data into the analog data signal using gradation voltages obtained by subdividing the plurality of reference gamma voltages supplied from the gamma voltage generator 500. The data driver 300 can supply a reference voltage to the reference line.

In the sensing mode, the data driver 300 can supply a data voltage for sensing to data lines to drive each pixel according to control of the timing controller 400, senses a pixel current that represents electrical characteristics of a driven pixel as a voltage through the reference line Rm, converts the sensed voltage into digital sensing data and provides the digital sensing data to the timing controller 400.

The timing controller 400 controls the gate driver 200 and the data driver 300 using timing control signals supplied from an external system and timing setting information stored therein. The timing control signals may include a dot clock signal, a data enable signal, a vertical synchronization signal, a horizontal synchronization signal, and the like. The timing controller 400 generates a plurality of gate control signals for controlling operation timing of the gate driver 200 and supplies the plurality of gate control signals to the gate driver 200. The timing controller 400 generates a plurality of data control signals for controlling operation timing of the data driver 300 and supplies the plurality of data control signals to the data driver 300.

The timing controller 400 can perform definition improvement processing such as compensation of an initial characteristic deviation of each pixel and compensation of deterioration (image sticking) on image data. The timing controller 400 can reduce power consumption by analyzing the image data and controlling luminance.

The timing controller 400 can execute a sensing function of driving the panel 100 in the sensing mode by controlling the gate driver 200 and the data driver 300 and sensing a threshold voltage of the driving TFT DT, mobility of the driving TFT DT, and a threshold voltage of the emission element 10 in which a characteristic deviation and deterioration of each pixel of the panel 100 have been reflected through the data driver 300. The timing controller 400 can perform definition improvement processing for compensating for the characteristic deviation and deterioration of each pixel using a sensing result. The timing controller 400 may accumulate data used in pixels as stress data and additionally perform definition improvement processing for compensating for deterioration of the pixels according to the accumulated stress data.

When the timing controller 400 performs definition improvement processing, the timing controller 400 can download compensation data stored in an external memory 700 that is an inactive memory to an internal memory 440 that is an active memory and use the compensation data. The timing controller 400 can upload compensation data updated in the internal memory 440 to the external memory 700 according to a sensing result of a corresponding pixel. The timing controller 400 can upload stress data accumulated in the internal memory 440 to the external memory 700 according to data of each pixel.

When the shape of the panel 100 changes and thus the area of the first display area in which an actual image is displayed in the display area DA changes, the timing controller 400 can download compensation data corresponding to pixels corresponding to the first display area having the changed area from the external memory 700 to the internal memory 440 and use the compensation data for data compensation. The timing controller 400 can update the downloaded compensation data in the internal memory 440 using a sensing result with respect to the pixels corresponding to the first display area having the changed area and upload the updated compensation data to the external memory 700. The timing controller 400 can accumulate data used by the pixels corresponding to the first display area having the changed area in the internal memory 440 as stress data and upload the accumulated stress data to the external memory 700.

When compensation data is downloaded, the timing controller 400 may sample compensation data of a certain pixel for each block unit including N*N (N being an integer equal to or greater than 2) pixels from the external memory 700, download sampled compensation data to the internal memory 440 and compensate for data of corresponding pixels using the downloaded compensation data in consideration of capacity restriction of the internal memory 440. Accordingly, a data compensation resolution may be lower than a pixel resolution.

When the shape of the panel 100 changes and thus the area of the first display area in which an image is displayed in the display area DA changes, the timing controller 400 can detect shape change of the panel 100 through the sensor 800, calculate the changed area of the first display area and change a data processing resolution in response to the changed area of the first display area. The timing controller 400 can change the resolution of compensation data sampled and downloaded from the external memory 700 to the internal memory 440 in response to the changed data processing resolution and change a compensation resolution of data processed using the compensation data. Since the position of the compensation data sampled from the external memory 700 also changes according to the changed data processing resolution, the position of compensated data also changes.

The timing controller 400 can change a distance between pixels to be compensated in the pixels corresponding to the first display area in response to the changed area of the first display area.

For example, when a foldable panel 100A is folded as shown in FIG. 3 or a rollable panel 100B is rolled by a rolling device 110 as shown in FIG. 4, the timing controller 400 can display an image only in a first display area DA1 corresponding to a viewing area in the display area DA and stop operation of circuits corresponding to a non-viewing area or display black in the non-viewing area.

Accordingly, when the foldable panel 100A is folded or the rollable panel 100B is rolled, the area of the first display area (viewing area) DA1 in which an image is displayed in the display area DA is reduced.

The timing controller 400 can detect change of the shape of the panel 100 to a folding state or a rolled state through the external sensor 800 and calculate a reduced area or aspect ratio of the first display area DA1 using the detection signal representing the changed area and information on the shape of the display. The timing controller 400 displays a corresponding image in the first display area DA1. When the timing controller 400 downloads compensation data of pixels corresponding to the reduced first display area DA1 from the external memory 700 to the internal memory 440 in units of a block, the timing controller 400 can increase the resolution of compensation data corresponding to the first display area DA1 by reducing a distance between positions at which compensation data is sampled from the external memory 700 in response to area reduction of the first display area DA1 and improve the data compensation resolution using the compensation data.

Figure 5:
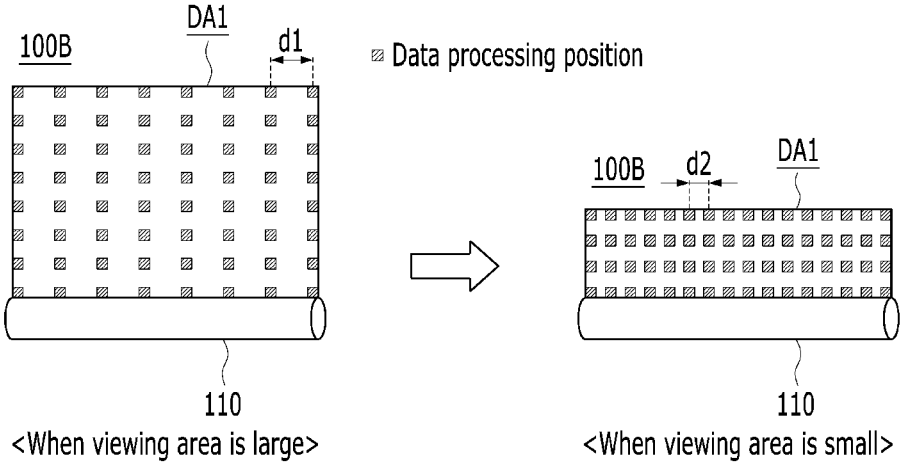
FIG. 5 is a diagram showing change in a sampling resolution of data according to change in a display area of a display device according to various embodiments.

For example, when the area of the first display area (viewing area) DA1 in which an image is displayed decreases according to a rolled state of the rollable panel 100A, as shown in FIG. 5, the timing controller 400 can increase the resolution (density) of compensation data downloaded from the external memory 700 to the internal memory 440 and increase the compensation resolution (density) of data processed using the compensation data. A distance d2 between pixels compensated using the compensation data in pixels corresponding to the first display area DA1 having a reduced area may be reduced to be less than a distance d1 between pixels compensated when the area of the first display area (viewing area) DA1 is not changed. That is, when data is compensated through sampling in units of a block, the size of the block unit can be reduced. Accordingly, the compensation resolution (density) of data increases in the first display area DA1 having a reduced area to improve image processing capability and thus product quality can be enhanced and lifespan of products can be extended.

Figure 6:
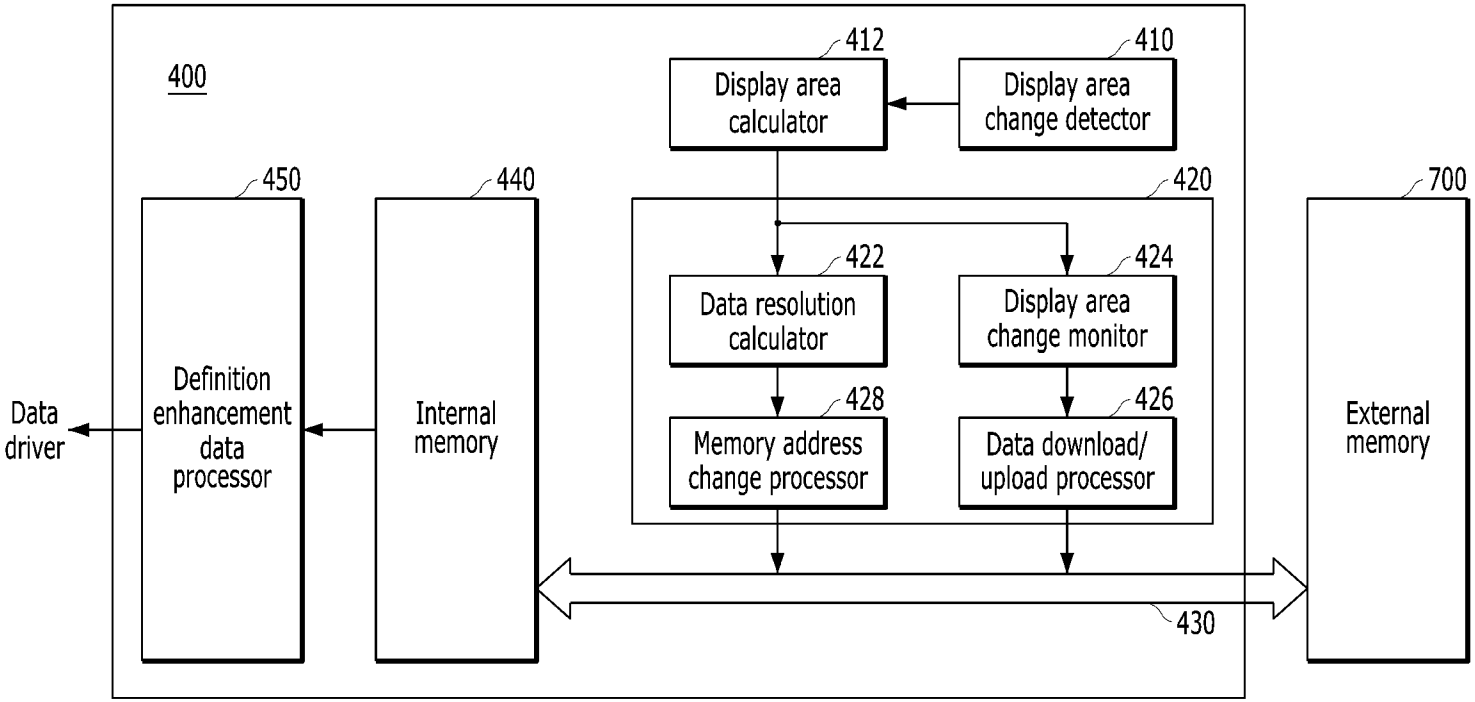
FIG. 6 is a block diagram showing a configuration of a timing controller according to various embodiments.

FIG. 6 is a block diagram showing a configuration of the timing controller according to various embodiments.

Referring to FIG. 6, the timing controller 400 may include a display area change detector 410, a display area calculator 412, a memory controller 420, an internal memory 440, and a definition enhancement data processor 450. The memory controller 420 may include a data resolution calculator 422, a memory address change processor 428, a display area change monitor 424, and a data download/upload processor 426 and may further include other components.

The display area change detector 410 can detect change in the shape of the panel 100 such as a folding state or a rolled state of the panel 100 through the external sensor 800 and detect change in the area of the first display area DA1 according to the shape change.

The display area calculator 412 can calculate the changed area of the first display area DA1 detected by the display area change detector 410. Here, the display area calculator 412 may receive information on change in the shape of the panel 100 through the display area change detector 410 and calculate the area of the first display area DA1 changed according to shape change. For example, when the panel 100 is a panel rolled by a motor of a rolling device, the display area calculator 412 can calculate the area of the first display area (viewing area) DA1 in which an image is displayed in the display area DA in a rolled state using the rotational speed and rotating state of the rolling motor and information on the display area DA of the panel 100.

The data resolution calculator 422 of the memory controller 420 can calculate a data processing resolution in response to the calculated area of the first display area DA1. When the area of the first display area DA1 is reduced, the data processing resolution can increase.

The memory address change processor 428 changes an address at which compensation data is sampled from the external memory 700 according to the calculated data resolution.

The download/upload processor 426 can sample compensation data from the external memory 700 according to the changed address, download the compensation data to the internal memory 440 through a bus 430, and upload compensation data updated in the internal memory 440 to the external memory 700 through the bus 430.

There may be a bandwidth issue when data stored in the memory 440 is changed in real time in response to change in the area of the first display area DA1. Accordingly, the display area change monitor 424 controls the download/upload processor 426 to perform download/upload processing when a display area calculated by the display area calculator 412 is fixed for a predetermined time or longer. The display area change monitor 424 can change an update period of the internal memory 440, that is, a download/upload period, by controlling the data download/upload processor 426.

The definition enhancement data processor 450 can compensate for data of a corresponding pixel using compensation data downloaded from the external memory 700 to the internal memory 440. When the first display area DA1 is reduced due to change in the shape of the panel 100, the resolution of compensation data downloaded to the internal memory 440 increases and thus the compensation resolution of compensated data can be enhanced.

For example, when the area of the first display area DA1 is changed to 100%, 50% and 25% and the pixel resolution of the first display area DA1 is reduced, as shown in the table 1 below, it is possible to increase the compensation resolution by reducing the size of a data compensation processing block unit using 100% of the fixed capacity of the internal memory 440.

TABLE 1

| Display area (@4K) | Horizontal resolution (C) | Vertical resolution (R) | Total number of pixels (K = R × C) | Memory depth (fixed) (S) | Compensation resolution (N × M) |
|---|---|---|---|---|---|
| 100% | 3840 | 2160 | 8294400 | 32400 | 16 × 16 |
| 50% | 3840 | 1080 | 4147200 | | 16 × 8 |
| 25% | 3840 | 540 | 2073600 | | 8 × 8 |

Figure 7:
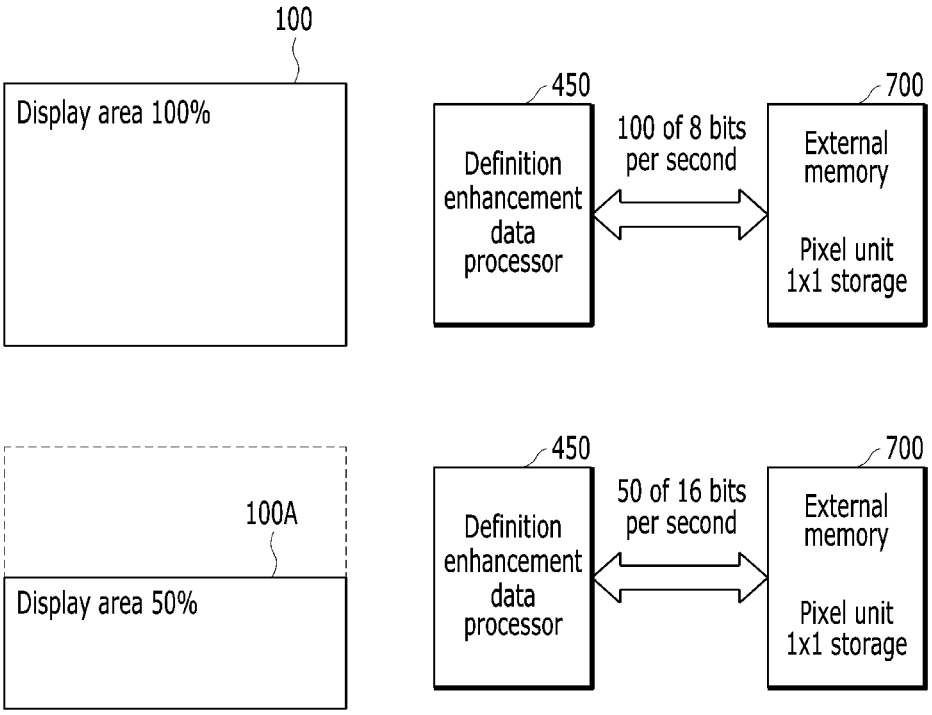
FIG. 7 is a block diagram showing a configuration of the timing controller according to various embodiments.

FIG. 7 is a diagram showing a configuration of the timing controller according to various embodiments.

Referring to FIG. 7, when the definition enhancement data processor 450 in the timing controller 400 spatially processes data in real time using the external memory 700 without using the internal memory 440, a data bandwidth increases in a condition restricted according to reduction in the area of the first display area DA1. Accordingly, a bit depth of compensation data or accumulated stress data allocated per pixel can be extended.

For example, when the area of the first display area DA1 decreases from 100% to 50%, a bit depth of data allocated per pixel can be extended twice, for example, 8-bit data can be extended to 16-bit data. Accordingly, the bit depth of compensation data or accumulated stress data can be extended and thus a compensation range of the compensation data or an accumulation range of the accumulated stress data can be increased to improve the performance of compensation using the compensation data or the accumulated stress data or achieve accurate compensation.

The display device according to various embodiments can change the resolution (density) of compensation data downloaded from the external memory to the internal memory according to change in the area of the display area to change the spatial processing resolution (density) of data processed using the compensation data.

Accordingly, when the area of the display area is reduced according to change in the panel shape of the display device, image processing capability can be improved by increasing the resolution of compensation data and the compensation resolution of data processed using the compensation data to improve product quality and extend the lifespan of products.

The display device according to various embodiments can extend a bit depth of compensation data or accumulated stress data according to change in the area of the display area to improve compensation capability using the compensation data or the accumulated stress data and thus can improve image processing capability and extend the lifespan.

It will be apparent to those skilled in the art that various modifications and variations can be made in the present disclosure without departing from the spirit or scope of the disclosure. Thus, it is intended that the present disclosure covers the modifications and variations of this disclosure provided they come within the scope of the appended claims and their equivalents.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device, comprising:

a panel including a display area, the panel including a plurality of pixels and having a variable physical shape;

a panel driver for driving the panel; and a timing controller for varying the area of a first display area in which an image is displayed in the display area according to change in the shape of the panel in response to detecting the change in the shape of the panel through a sensor and varying a distance between pixels in the first display that are selected based on the distance for compensation processing in response to the varied area of the first display area, wherein the timing controller reduces the distance between the selected pixels that is used for the compensation processing when the area of the first display area decreases.

2. The display device of claim 1, wherein the panel is a foldable panel or a rollable panel.

3. A display device, comprising:

a panel including a display area, the panel including a plurality of pixels and having a variable physical shape;

a panel driver for driving the panel; and a timing controller for varying the area of a first display area in which an image is displayed in the display area according to change in the shape of the panel in response to detecting the change in the shape of the panel through a sensor and varying a distance between pixels in the first display that are selected based on the distance for compensation processing in response to the varied area of the first display area, wherein the timing controller varies the distance between the selected pixels by changing a sampling position of compensation data downloaded from an external memory to an internal memory in response to the varied area of the first display area and compensating for data of the selected pixels using the downloaded compensation data.

4. A display device, comprising:

a panel including a display area, the panel including a plurality of pixels and having a variable physical shape;

a panel driver for driving the panel; and a timing controller for varying the area of a first display area in which an image is displayed in the display area according to change in the shape of the panel in response to detecting the change in the shape of the panel through a sensor and varying a distance between pixels in the first display that are selected based on the distance for compensation processing in response to the varied area of the first display, wherein the timing controller includes:

a display area change detector for detecting change of the first display area according to the change in the shape of the panel;

a display area calculator for calculating the varied area of the first display area;

a data resolution calculator for calculating a data processing resolution corresponding to the calculated area of the first display area;

a memory address change processor for varying an address according to the calculated data processing resolution;

a data download processor for sampling compensation data from an external memory using the varied address and downloading the compensation data to an internal memory; and a definition enhancement data processor for compensating for data of the selected pixels using the downloaded compensation data.

5. The display device of claim 4, wherein the timing controller further includes a display area change monitor for monitoring the area of the first display area calculated by the display area calculator, and when the varied area of the first display area is maintained for a set period, the display area change monitor controls the data download processor to download the compensation data from the external memory to the internal memory.

6. A data processing method of a display device, comprising:

detecting change in the area of a display area in which an image is display according to change in a shape of a panel;

calculating the changed area of the display area according to change in the shape of the panel;

calculating a data processing resolution corresponding to the calculated display area;

sampling compensation data from an external memory and downloading the compensation data to an internal memory in response to the calculated data processing resolution; and compensating for data of a corresponding pixel using the compensation data downloaded to the internal memory.

7. The data processing method of claim 6, wherein, when the area of the display area decreases, the data processing resolution increases, there to enhance both a resolution of the downloaded compensation data and a resolution of the compensated data.

8. The data processing method of claim 6, further comprising monitoring the calculated area of the display area, and when the changed area of the display area is maintained for a set period, controlling the compensation data that the compensation data is downloaded from the external memory to the internal memory.

* * * * *